US005744765A

United States Patent [19]

Yamamoto

[11] Patent Number: 5,744,765

[45] Date of Patent: Apr. 28, 1998

[54] LEVER SWITCH WITH SUPPORT WALLS FOR SUPPORTING MOVABLE CONTACT POINTS AND METHOD OF DETECTING AN OPERATING DIRECTION OF A LEVER SWITCH

[75] Inventor: Tetsuo Yamamoto, Yokkaichi, Japan

[73] Assignee: Sumitomo Wiring Systems, Ltd., Yokkaichi, Japan

[21] Appl. No.: 661,377

[22] Filed: Jun. 11, 1996

[30] Foreign Application Priority Data

Jun. 19, 1995 [JP] Japan ..... 7-176825
Oct. 3, 1995 [JP] Japan ..... 7-282484

[51] Int. Cl.[6] ..... H01H 25/04; H01H 13/70; H01H 9/00

[52] U.S. Cl. ..... 200/6 A; 200/5 R; 200/5 A; 200/339

[58] Field of Search ..... 200/153, 9, 5 A, 200/6 A, 5 R, 339; 345/156

[56] References Cited

U.S. PATENT DOCUMENTS

| | | | |
|---|---|---|---|
| 4,052,578 | 10/1977 | Hoke . | |
| 4,280,027 | 7/1981 | Comerford et al. . | |
| 4,309,582 | 1/1982 | Coors . | |
| 4,668,843 | 5/1987 | Watanabe et al. . | |
| 4,687,200 | 8/1987 | Shirai | 200/5 A |
| 4,739,128 | 4/1988 | Grisham . | |
| 4,758,692 | 7/1988 | Roeser et al. . | |
| 5,115,108 | 5/1992 | Ogawa et al. . | |
| 5,224,589 | 7/1993 | Karakama et al. . | |
| 5,227,594 | 7/1993 | Russo . | |
| 5,313,027 | 5/1994 | Inoue et al. . | |
| 5,426,275 | 6/1995 | Maeda et al. . | |
| 5,430,262 | 7/1995 | Matsui et al. | 200/5 A |
| 5,459,292 | 10/1995 | Nagano et al. . | |
| 5,468,924 | 11/1995 | Naitou et al. . | |
| 5,510,810 | 4/1996 | Nishijima et al. . | |

FOREIGN PATENT DOCUMENTS

| | | |
|---|---|---|
| 0 246 968 | 11/1987 | European Pat. Off. . |
| 0 337 045 | 10/1989 | European Pat. Off. . |
| 0 348 202 | 12/1989 | European Pat. Off. . |
| 0 516 870 | 12/1992 | European Pat. Off. . |
| 0 640 937 | 3/1995 | European Pat. Off. . |
| 0 656 640 | 6/1995 | European Pat. Off. . |
| 0 691 666 | 1/1996 | European Pat. Off. . |
| 1 268 251 | 5/1968 | Germany . |
| 2 035 283 | 2/1971 | Germany . |
| 92 01 236.1 | 4/1992 | Germany . |
| U-61-201244 | 12/1986 | Japan . |
| 7-84717 | 3/1995 | Japan . |
| 8-111144 | 4/1996 | Japan . |
| 2 145 502 | 3/1985 | United Kingdom . |

*Primary Examiner*—Peter S. Wong
*Assistant Examiner*—Rajnikant B. Patel
*Attorney, Agent, or Firm*—Oliff & Berridge, PLC

[57] ABSTRACT

A selecting switch operating section provided to support movable contact points includes circular elastic support walls disposed along an arrangement circle of selecting stationary contact points, and a pushing portion. When the selecting switch operating section is pushed by an operating portion tilted integrally with the operating lever, at least one of movable contact points comes into contact with at least one of the selecting stationary contact points. Thus, it is not necessary to provide accommodation space for other members between the adjacent selecting stationary contact points. Also, it is possible to reduce the spacing interval between adjacent selecting stationary contact points in the arrangement circle, so that the diameter of the arrangement circle can be reduced and the entire lever switch can be reduced in size.

23 Claims, 9 Drawing Sheets

LEVER SWITCH WITH SUPPORT WALLS FOR SUPPORTING MOVABLE CONTACT POINTS AND METHOD OF DETECTING AN OPERATING DIRECTION OF A LEVER SWITCH

BACKGROUND OF THE INVENTION

The invention relates to a lever switch operated by an operating lever when the operating lever is tilted.

A conventional lever switch is shown in FIGS. 1 and 2. The conventional lever switch includes a plurality of stationary contact points 71 arranged in a circle on a printed circuit board 70. Elastically flexible portions 73 are provided on a rubber switch cover 74. Each elastically flexible portion 73 is in the shape of an upside down bowl. A movable contact point 72 attaches to a reverse side of each elastically flexible portion 73.

A tiltable operating lever 75 is positioned above an upper surface of the switch cover 74. The operating lever 75 is located at a center of the circle in which the stationary contact points 71 are arranged. A flange 76 is interlocked with the operating lever 75. An operating pin 77 is provided between the flange 76 and the elastically flexible portion 73. The operating pin 77 is supported such that it can be displaced in an upward and downward direction. When the operating lever 75 is tilted, the flange 76 is tilted and pushes the operating pin 77 downward, so that the elastically flexible portion 73 is elastically deformed and crushed downward. As a result, the movable contact point 72 comes into contact with the stationary contact point 71.

In this type of lever switch, a movable contact point 72 is provided for each stationary contact point 71. When a corresponding movable contact point 72 is contacted, the stationary contact point 71 can be short-circuited. Thus, it is necessary for a predetermined movable contact point 72 to be positioned for each stationary contact point 71.

The bowl-shaped elastically flexible section 73 for positioning a predetermined movable contact point for each stationary contact point is provided on the rubber switch cover 74, which is attached to the printed board 70. Each bowl-shaped elastically flexible section 73 independently surrounds each movable contact point 71, and each movable contact point 72 attaches to a reverse side of each elastically flexible section 73.

To reduce the size of the lever switch, it is necessary to reduce the diameter of the circle in which the stationary contact points 71 are arranged. However, when the diameter of the circle is reduced, the intervals between adjacent stationary contact points 71 in the circle are also reduced. As set forth above, in the arrangement of the conventional lever switch, an elastically flexible portion 73 supports the movable contact point 72 for each stationary contact point 71 such that each stationary contact point 71 is surrounded by the elastically flexible portion 73. Further, a cylindrical supporting member 78 supports the operating pin 77 for each stationary contact point 71. Therefore, it is necessary to provide a space between the stationary contact points 71, in which the elastically flexible portion 73 and the supporting member 78 are arranged. For the foregoing reasons, it is difficult to reduce the lever switch in size.

Because it is necessary to provide a space for accommodating the elastically flexible section 73 between the movable contact points 72 discussed above, when one attempts to enhance resolution in the operating direction, the diameter of the circle in which the stationary contact points 71 are arranged is increased, increasing all of the dimensions of the lever switch. To reduce the dimensions, the diameter of the circle must be reduced. When the diameter of the circle is reduced, the number of the stationary contact points 71 must be reduced. Reducing the number of the stationary contact points 71 deteriorates resolution in the operating direction.

SUMMARY OF THE INVENTION

In view of the foregoing, it is an object of the invention to provide a lever switch that is miniaturized and achieves enhanced resolution.

According to a first embodiment of the invention, a lever switch includes a circuit board; a plurality of stationary contact points arranged in a circle on the circuit board; a plurality of corresponding movable contact points supported so that the plurality of corresponding movable contact points are separated from the stationary contact points; an operating lever arranged at a center of the circle in which the plurality of stationary contact points are arranged, wherein the plurality of movable contact points come into contact with the plurality of stationary contact points when the operating lever is tilted; and an operating section attached to the operating lever, the operating section being structured to push the plurality of movable contact points toward the stationary contact points when the operating section is tilted integrally with the operating lever. Thus, when the operating lever is tilted, the operating section pushes at least one of the plurality of movable contact points and causes it to come into contact with at least one of the plurality of stationary contact points.

Moreover, elastic support walls can be respectively arranged on the inner and the outer circumferences of the circle of movable contact points. The elastic support walls are continuously formed as circles, and the plurality of movable contact points are supported by the elastic walls. When the operating lever is tilted, the operating section elastically deforms the elastic support walls thereby pushing at least one of the plurality of movable contact points and causing it to come into contact with at least a corresponding one of the stationary contact points.

Furthermore, according to a second embodiment of the invention, a lever switch includes a circuit board; a plurality of stationary contact points, each formed of a plurality of electrodes, the plurality of stationary contact points being arranged in a circle on the circuit board; a plurality of movable contact points capable of contacting with and separating from a corresponding one of the plurality of stationary contact points; and an operating lever arranged at a center of the circle in which the plurality of stationary contact points are arranged, wherein when the operating lever is tilted at least one of the plurality of movable contact points comes into contact with at least a corresponding one of the stationary contact points so that the electrodes can be short-circuited, and wherein the plurality of movable contact points are arranged continuously in a circle corresponding to the circle in which the stationary contact points are arranged.

Further, the plurality of electrodes forming a stationary contact point can be arranged in the radial direction. Furthermore, one of the plurality of electrodes forming the stationary contact points is a common electrode, and the common electrodes of each of the stationary contact points are connected with each other in a circle in which the stationary contact points are arranged.

Also, according to the second embodiment, the lever switch may further comprise a short circuit detecting mechanism for detecting a plurality of stationary contact points that are simultaneously short-circuited; and a computing mechanism for computing a center of a region in the circumferential direction in which the simultaneously short-circuited stationary contact points are arranged, the position computed by the computing mechanism being determined to be an operating direction of the operating lever. Additionally, a counting mechanism may count the number of stationary contact points that are simultaneously short-circuited and determines an intensity of the operating force in accordance with the counted value. According to the invention, the elastic support walls for supporting the movable contact points may be, respectively, provided on the inner and the outer circumferences of the arrangement circle of the stationary contact points such that the elastic support walls are respectively in the form of continuous circles. Thus, it is possible to reduce the spacing between stationary contact points adjacent in the circumferential direction so that the lever switch can be reduced in size.

Further, the pushing of the movable contact point is not necessarily conducted using the operating pin supported separately from the operating lever, but may be conducted by the operating section provided integrally with the operating lever. Therefore, it is not necessary to provide a supporting member for supporting the operating pin. Consequently, it is possible to reduce the spacing between stationary contact points adjacent to each other in the circumferential direction so that the lever switch can be reduced in size. Furthermore, because the movable contact points are not each supported by a supporting structure arranged to surround each stationary contact point, it is possible to reduce the spacing between adjacent stationary contact points so that the lever switch can be reduced in size.

According to the second embodiment of the invention, when a movable contact point comes into contact with a stationary contact point in a predetermined region in which a plurality of electrodes forming the stationary contact point are arranged in the radial direction, these electrodes are short-circuited. Accordingly, in contrast to an arrangement in which a plurality of electrodes forming a stationary contact point are arranged in the circumferential direction, it is possible to miniaturize and enhance resolution of the lever switch. It is also possible to reduce a length of the wiring in the electrical circuit and to simplify the electrical circuit.

Furthermore, according to the invention, when two stationary contact points are simultaneously short-circuited, an intermediate position between the two stationary contact points can be determined to be a direction in which the lever is operated. Accordingly, in contrast to the structure in which only a position of the stationary contact point that has been mounted on the printed board is decided to be an operating direction, the resolution can be doubled.

Furthermore, the larger the number of simultaneously short-circuited stationary contact points is, the higher the intensity of the decided operating force. Since the intensity of the operating force can be detected, it is possible to conduct a highly sophisticated operation. For example, the operation can be conducted such that the stronger the operating force is, the higher the operating speed is increased.

BRIEF DESCRIPTION OF THE DRAWINGS

These and other aspects and advantages of the invention will become apparent from the following detailed description of preferred embodiments when taken in conjunction with the accompanying drawings in which.

DETAILED DESCRIPTION OF PREFERRED EMBODIMENTS

Figure 1:
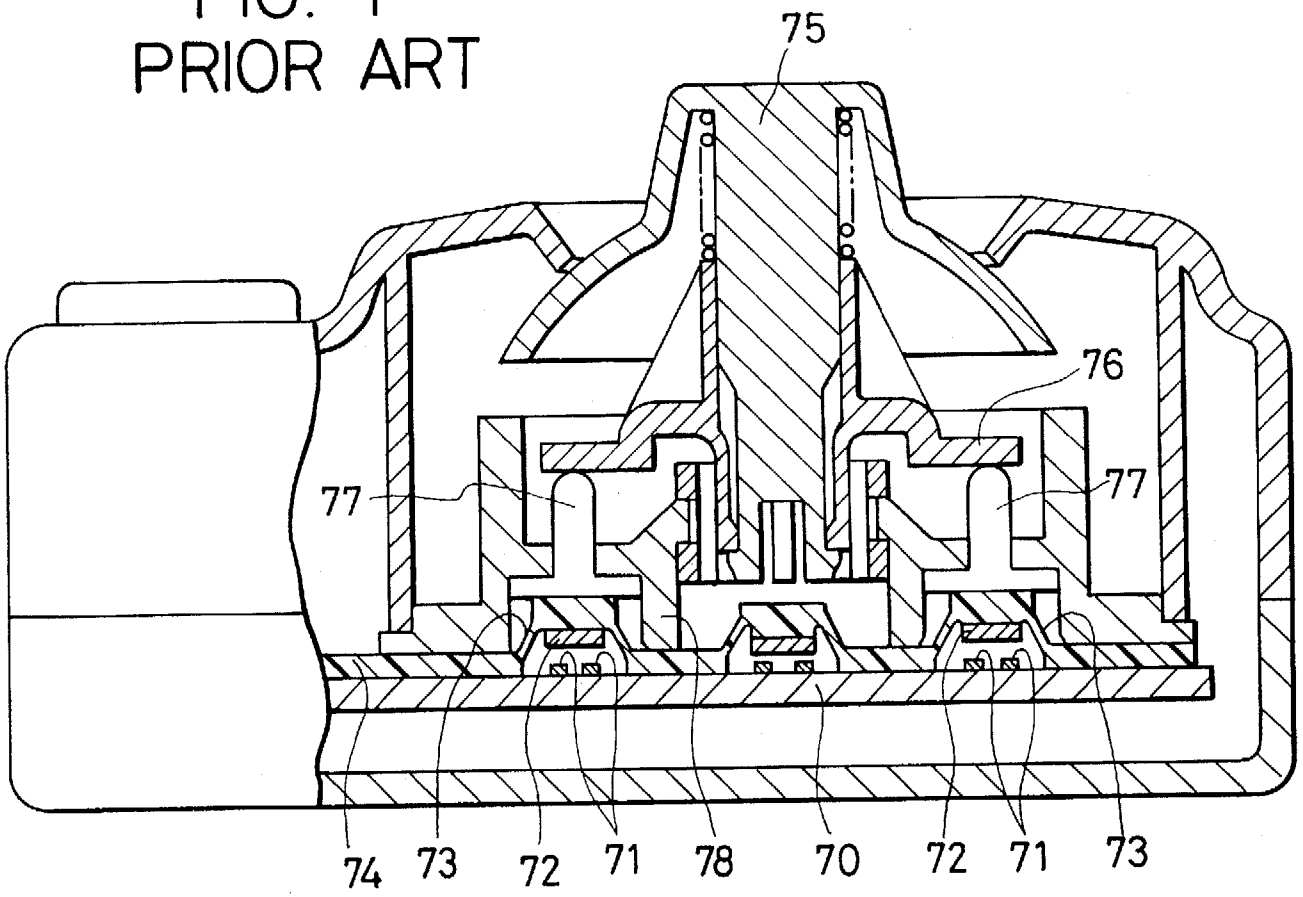
FIG. 1 PRIOR ART
FIG. 1 is a cross-sectional view of a conventional lever switch.
Figure 2:
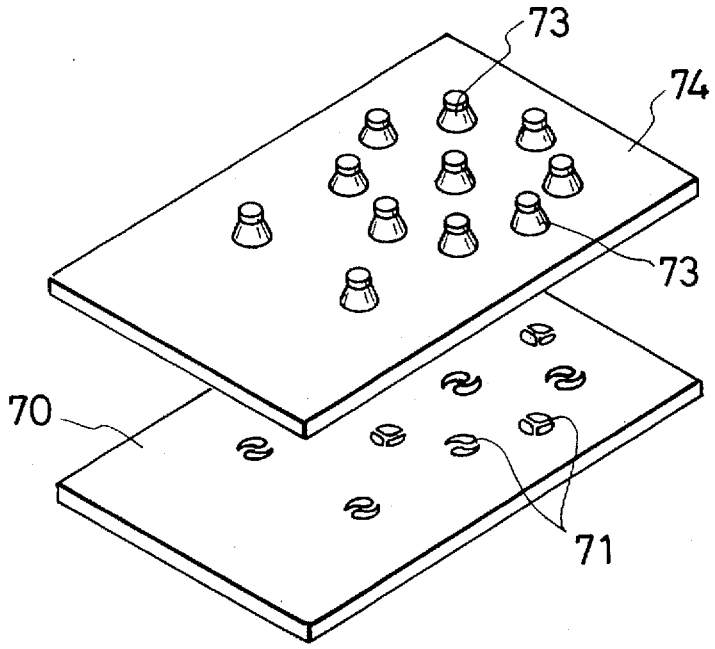
FIG. 2 PRIOR ART
FIG. 2 is a perspective view showing the printed board separated from the switch cover in the conventional lever switch.
Figure 3:
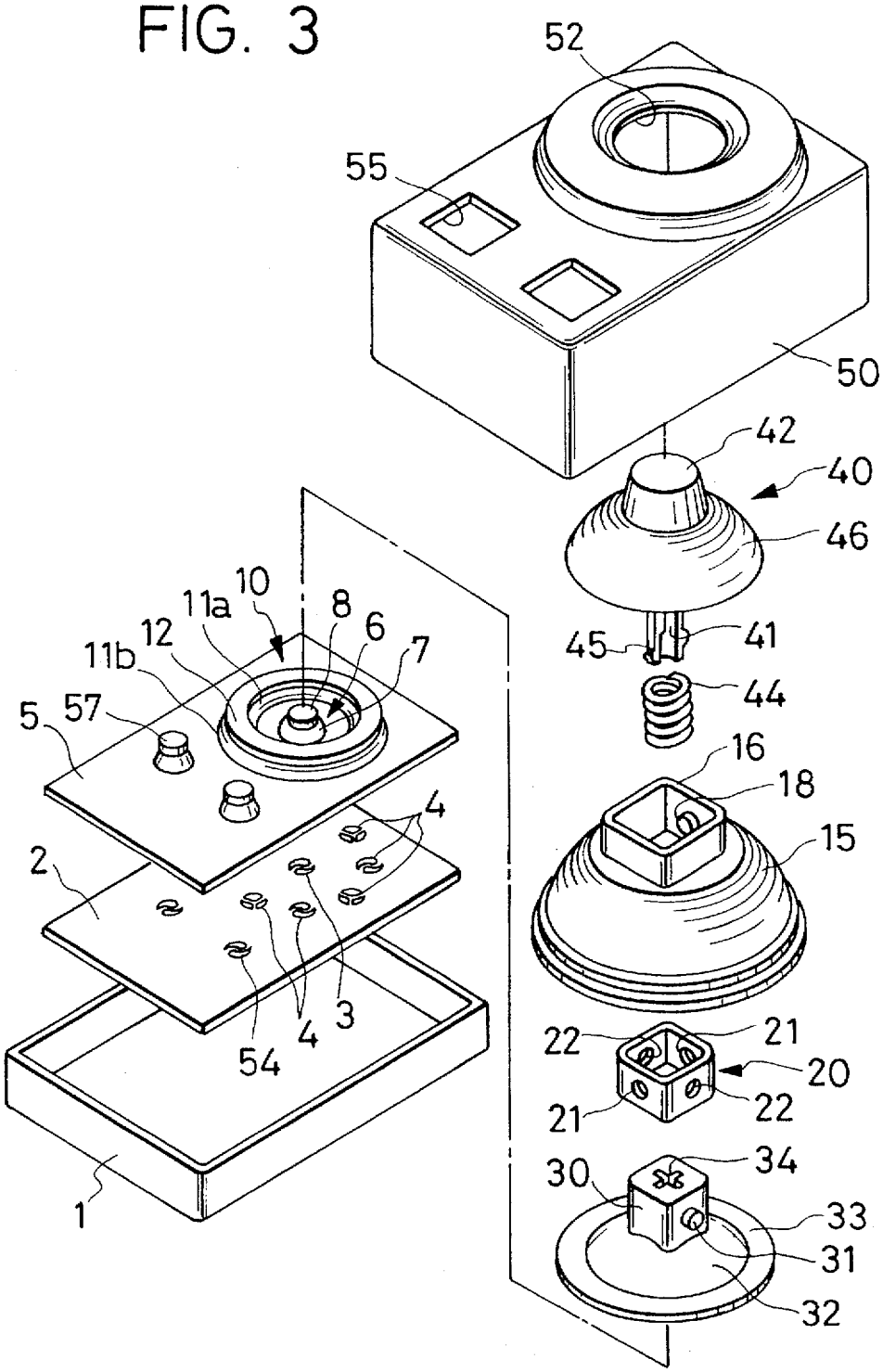
FIG. 3 is an exploded perspective view of a first embodiment of the invention.

While the invention will hereinafter be described in connection with preferred embodiments thereof, it will be understood that it is not intended to limit the invention to those embodiments. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate identical elements.

Referring to FIGS. 3 to 7, a first embodiment of the invention will be explained below.

In a shallow tray-shaped square case 1, a printed board 2 is fixed. The printed board 2 is a circuit board, on the reverse side (the bottom side in the drawings) of which circuit parts such as ICs, transistors, condensers and so forth (not shown) are attached. On the front surface (the lower side in the drawings) of the printed board 2, a setting stationary contact point 3 is provided, and in a circle, at the center of which is located the stationary contact point 3, eight selecting stationary contact points 4 are arranged at intervals of 45°.

An elastic and electrically insulating switch cover 5 made of rubber is attached to the surface of the printed board 2. The switch cover 5 is a thin film that covers the overall surface of the printed board 2. At a position corresponding to the stationary contact point 3, a setting switch operating section 6 is provided. The setting switch operating section 6 includes a thin elastic support portion 7 that extends up from the surface of the switch cover 5 in a tapered cylindrical shape such that it surrounds the setting stationary contact point 3 and a circular head portion 8 located at a protruding end of the elastic support portion 7. A disk-shaped movable contact point 9 (FIG. 4) made of rubber having electrical conductivity attaches to a reverse side of the head portion 8. The elastic support section 7 supports the movable contact point 9 such that it is separated from the setting stationary contact point 3. When the head portion 8 is pushed, the elastic support portion 7 elastically deforms and the movable contact point 9 comes into contact with the setting stationary contact point 3. Therefore, the setting stationary contact point 3 is electrically contacted. When the pushing operation on the head portion 8 is released, the movable contact point 9 is separated from the setting stationary contact point 3 by the elastic restoring force of the elastic support portion 7.

On the switch cover 5, a selecting switch operating section 10 is formed in the shape of a circle and extends up from the printed board 2. The circle surrounds the setting stationary contact point 3, and the eight selecting stationary contact points 4 are arranged along the circle. The circle is referred to as an arrangement circle, hereinafter.

The selecting switch operating section 10 includes thin elastic support walls 11*a*, 11*b* that extend up from the switch cover 5 along inner and outer circumferences of the circle formed by the selecting stationary contact points 4. A pushing portion 12 connects end portions of both elastic support walls 11*a*, 11*b* and is formed in an annular shape along the arrangement circle of the selecting stationary contact points 4.

Figure 4:
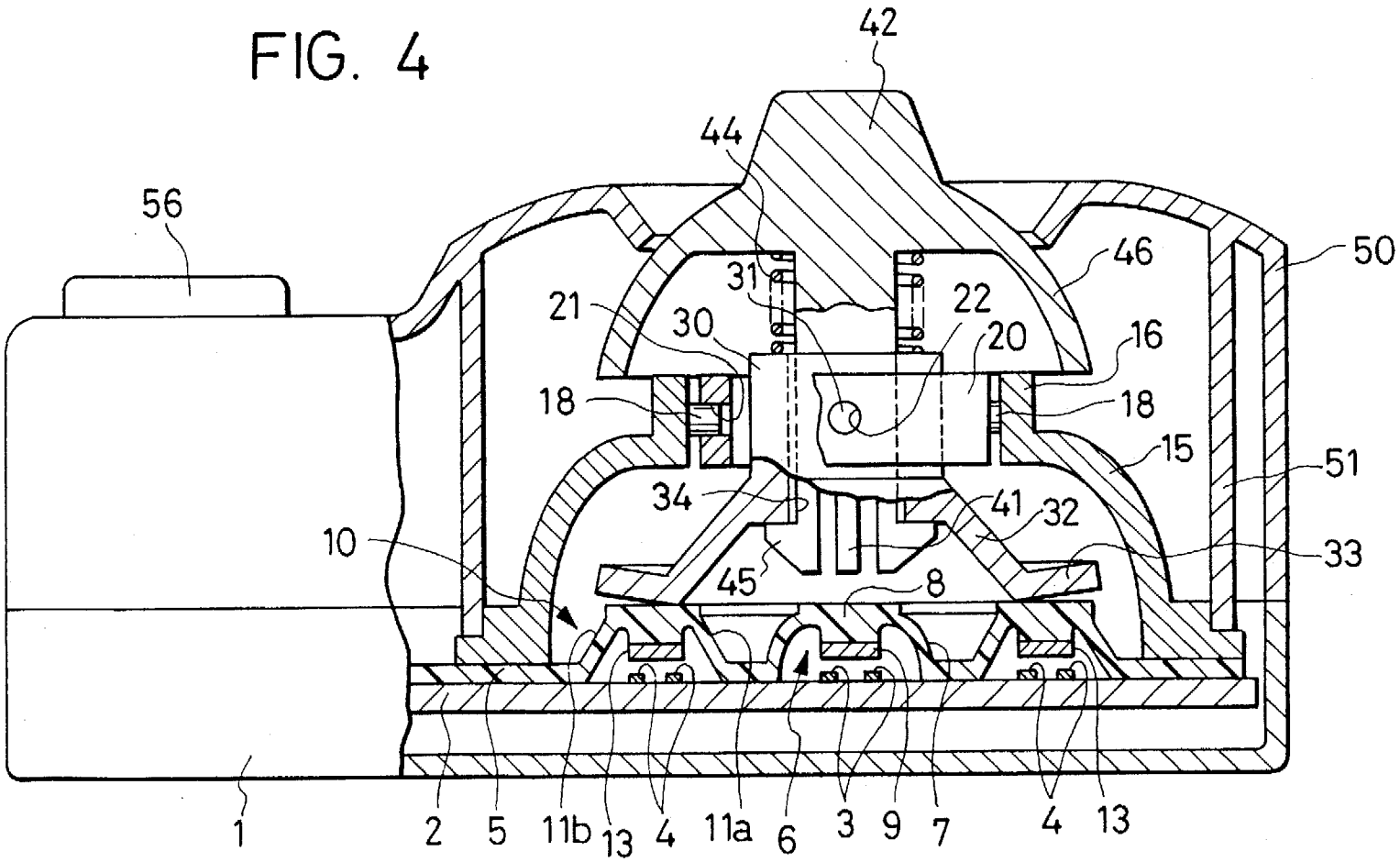
FIG. 4 is a cross-sectional view showing the operating lever in a neutral position.

The selecting switch operating section 10 has a trapezoidal cross-section as shown in FIG. 4. Eight disk-shaped movable contact points 13 made of electrically conductive rubber attach to a reverse side of the pushing portion 12. The movable contact points 13 are arranged such that they are located at positions directly above the selecting stationary contact points 4.

The movable contact points 13 are supported to be separated from the selecting stationary contact points 4. When the pushing portion 12 is partially pushed in the circumferential direction, the pushing portion 12 is elastically deformed and recessed. A movable contact point 13 in the recessed portion comes into contact with a selecting stationary contact point 4 so that the selecting stationary contact point 4 is electrically contacted. When the pushing operation on the pushing portion 12 is released, the selecting switch operating section 10 returns to its initial shape by the elastic restoring forces of the elastic support walls 11*a*, 11*b* so that the movable contact point 13 is again separated from the selecting stationary contact point 4.

On the switch cover 5, a dome-shaped base 15 is provided concentric with the arrangement circle of the selecting stationary contact points 4. The dome-shaped base 15 has an open portion at its top. The base 15 is positioned such that the periphery of the base 15 is held by a holding portion 51 of the cover 50, which will be described later. A square edge wall 16 is provided at the open portion of the base 15. A pair of supporting shafts 18, 18 arranged on a common axis protrude inward from the edge wall 16. The common axis of both supporting shafts 18, 18 meets at right angles with an imaginary perpendicular line rising from the center of the arrangement circle of the eight selecting stationary contact points 4 on the printed board 2.

A square cylindrical bearing body 20 is rotatably supported by the supporting shafts 18, 18 by means of bearing holes 21, 21 coaxially formed on the surfaces of the square cylindrical bearing body 20 parallel with each other, which are engaged with the supporting shafts 18, 18. Shaft insertion holes 22, 22 are formed on the other surfaces of the bearing body and are coaxial with each other. The common axis of the shaft insertion holes 22, 22 meets at right angles with an imaginary perpendicular line rising from the arrangement circle of the selecting stationary contact points 4 on the printed board 2 and also meets at right angles with the common axis of the supporting shafts 18, 18.

The bearing body 20 rotatably supports a square tilting body 30 by means of the shaft insertion holes 22, 22 into which are inserted rotary shafts 31, 31 protruding from the outside of the square tilting body 30. Because the tilting body 30 is supported by the supporting shafts 18, 18 and the rotary shafts 31 which meet at right angles with each other, it can be tilted with respect to the base 15 in an arbitrary direction centered on a point at which the axes of both shafts 18, 31 meet at right angles with each other.

On the outer circumference of the lower edge portion of the tilting body 30, a conic operating section 32 protrudes obliquely downward and away from the lower edge portion. When the tilting body 30 is in a neutral position, the overall circumference of the operating section 32 comes into contact with an upper surface of the pushing portion 12 of the selecting switch operating section 10. Further, at the periphery of the operating section 32, a pushing section 33 protrudes obliquely upward when the tilting body 30 is in the neutral position. As described above, the selecting switch operating section 10 is pushed in the upward direction by the elastic restoring forces of the elastic support walls 11*a*, 11*b*. Accordingly, the tilting body 30 can be maintained in a neutral position by the forces. However, when the tilting body 30 is tilted, a portion of the periphery of the operating section 32 in the tilting direction is displaced downward and pushes the pushing portion 12. When the tilting force is released, the tilting body 30 returns to the neutral position by the elastic restoring force of the selecting switch operating section 10.

In the tilting body 30, a supporting hole 34 is formed with a cross-shaped cross section taken in a direction perpendicular to the printed board 2 in a neutral position. The supporting hole 34 extends through the tilting body 30 from the upper end face to the lower end face. A leg portion 41 of the operating lever 40 is inserted into the supporting hole 34. A tapered cylindrical knob portion 42 is formed at an upper end of the leg portion 41. The leg portion 41 has a cross-shaped cross section. Accordingly, the tilting body 30 can freely move in the longitudinal direction of the leg portion 41 of the operating lever 40, but can not be rotated around a longitudinal axis of the leg portion 41. Also, the operating lever 40 is tilted together with the tilting body 30. The knob portion 42 of the operating lever 40 is formed in an umbrella-shape that expands in a direction of the base 15 to form an expanding portion 46. An outer surface of the expanding section 46 is spherical in surface shape and is centered on a point at which the supporting shaft 18 crosses the rotary shaft 31 where the two shafts make a right angle with each other.

As set forth above, the leg portion 41 of the operating lever 40 is inserted into the supporting hole 34. The operating lever 40 is pushed upward by a biasing member for example, a compression spring 44 provided between a reverse side of the knob portion 42 and an upper end surface of the tilting body 30. Therefore, the operating lever 40 is held in position while an engaging portion 45 formed at the lower end of the leg portion 41 engages with the lower end face of the tilting body 30. With this structure, there is a predetermined clearance between the lower end face of the leg portion 41 of the operating lever 40 and the head portion 8 of the setting switch operating section 6. When the operating lever 40 is moved in a direction so as to push the leg portion 41 into the tilting body 30, resisting a force of the return spring 44, the lower end face of the leg portion 41 comes into contact with the head portion 8 and pushes it toward the printed board 2. Thus, the movable contact point 9 contacts the setting stationary contact point 3.

Case 1 is covered with the cover 50 that covers each of the components described above. On the front face (the upper face in the drawings) of the cover 50, a circular window hole 52 is structured concentric with the base 15. The diameter of window hole 52 is larger than the diameter of the knob portion 42 of the operating lever 40. The knob portion 42 extends through the window hole 52. A small clearance is provided between an edge of the window hole 52 and an external surface of the extending portion 46 of the operating lever 40.

Two additional stationary contact points 54 are provided on the printed board 2. When an operation button 56 extending through a window hole 55 on the cover 50 is pushed and released, a movable contact point (not shown) provided in the switch operating section 57 of the switch cover 5 contacts and then separates from the stationary contact point 54.

Next, the operation of the selecting switch of the lever switch described above will be explained below. The operation is conducted such that the knob portion 42 of the operating lever 40 moves in a direction substantially parallel to the printed board 2.

When the moving direction of the knob portion 42 is perpendicular to the supporting shaft 18, the operating lever 40 is tilted around the supporting shaft 18 integrally with the tilting body 30 and the bearing body 20. When the moving direction of the knob portion 42 is perpendicular to the rotary shaft 31, the operating lever 40 is tilted around the rotary shaft 31 integrally with the tilting body 30. When the moving direction forms an angle of 45 degrees with respect to both the support shaft 18 and the rotary shaft 31, the bearing body 20 rotates around the support shaft 18, and at the same time, the tilting body 30 relatively rotates around the rotary shaft 31 with respect to the rotating bearing body 20 so that the operating lever 40 is tilted integrally with the tilting body 30. In either case, the operating lever 40 and the tilting body 30 are tilted around a point at which the axes of both the support shaft 18 and the rotary shaft 31 meet at a right angle with respect to each other.

Figure 5:
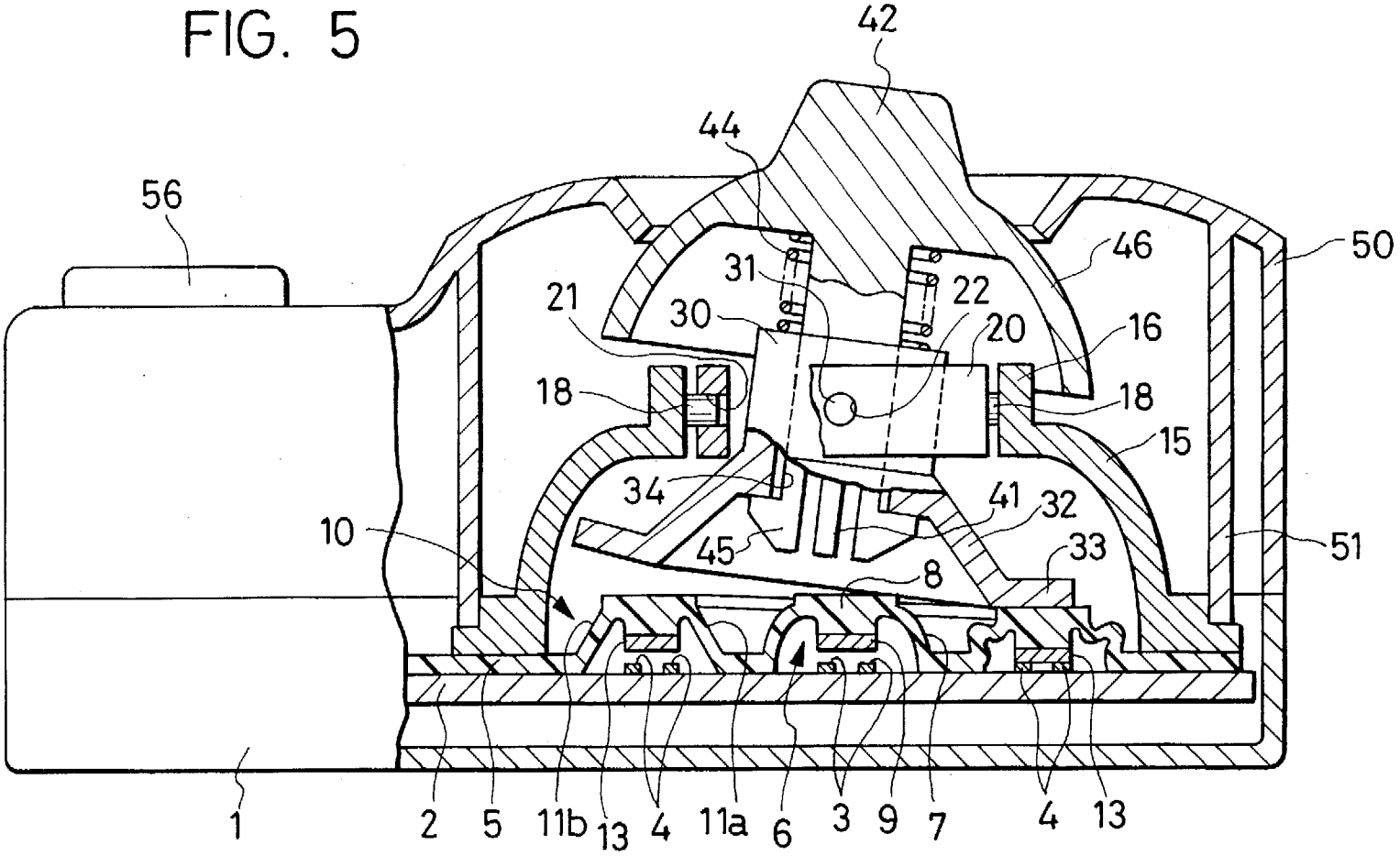
FIG. 5 is a cross-sectional view showing the operating lever in a tilted position.
Figure 6:
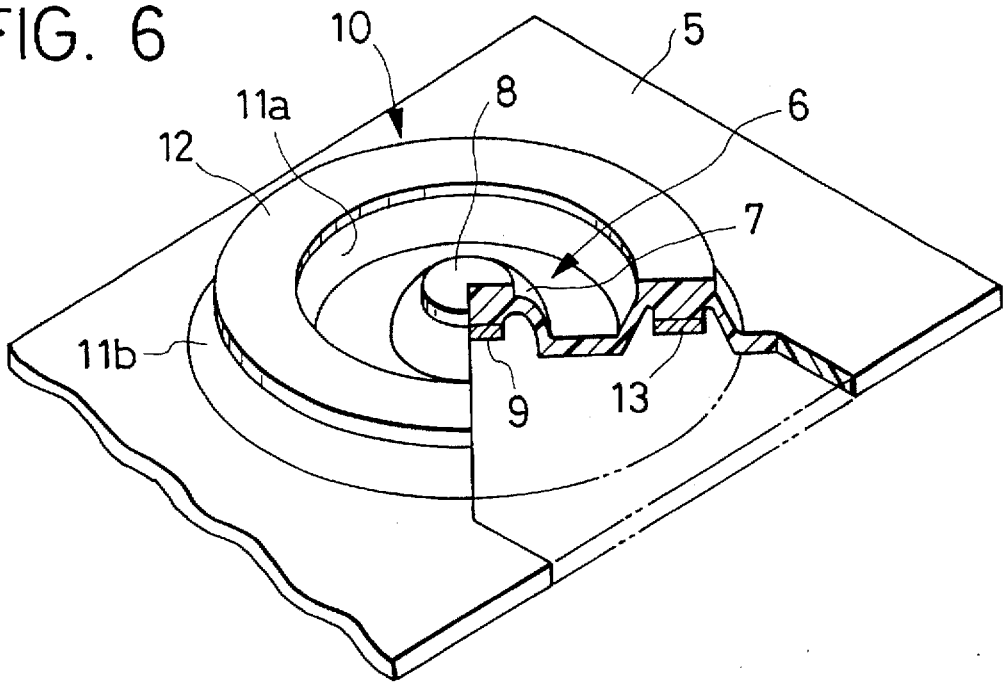
FIG. 6 is a partially cutaway perspective view of the selecting switch operating section.
Figure 7:
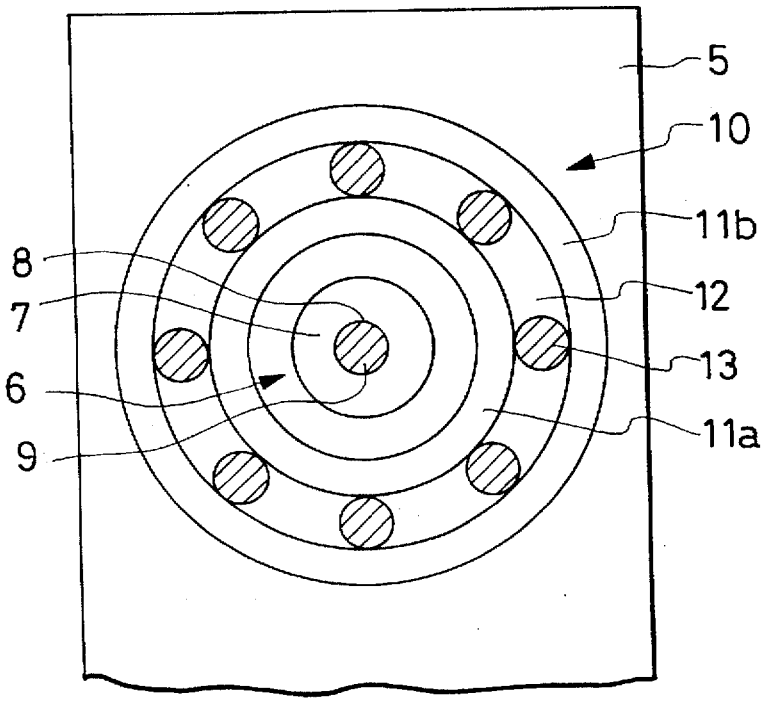
FIG. 7 is a rear view of the selecting switch operating section showing a shape of the movable contact point.

As shown in FIG. 5, when the tilting body 30 is tilted, a portion of the periphery of the operating section 32 located in the tilting direction is displaced downward and pushes the pushing portion 12. The movable contact point 13 that attaches to the pushing portion 12 is forced downward and contacts the selecting stationary contact point 4, so that a circuit including the selecting stationary contact point 4 is changed to an ON condition. When one movable contact point 13 simultaneously comes into contact with two adjacent selecting stationary contact points 4, 4 only a circuit including one of the selecting stationary contact points 4 is turned ON due to a compensating circuit provided in the main circuit. A circuit including the other selecting stationary contact point 4 is maintained in an OFF condition.

When the movable contact point 13 comes into contact with the selecting stationary contact point 4, a lower surface of the pushing section 33 becomes horizontal and pushes an upper surface of the pushing portion 12. Due to the foregoing, the movable contact point 13 comes into contact with the selecting stationary contact point 4 in a horizontal position as shown in FIG. 5. Thus, the movable contact point 13 can be positively short-circuited with the selecting stationary contact point 4.

When the knob portion 42 of the operating lever 40 is released, the tilting body 30 and the operating lever 40 integrally return from the tilted position to the neutral position by the restoring force of the selecting switch operating section 10, and the movable contact point 13 is separated from the selecting stationary contact point 4, so that the circuit is changed over to the OFF condition. Because the external surface of the expanding portion 46 is a spherical surface, the center of which is the same as the tilting center of the operating lever 40, the operating lever 40 does not contact an edge of the window hole 52 of the cover 50 when the operating lever 40 is tilted or returned to its initial or neutral position. When the operating lever 40 is tilted, only a predetermined small clearance exists between the edge of the window hole 52 and the expanding portion 46. Accordingly, foreign objects seldom enter the switch through the clearance.

As described above, the elastic support walls 11*a*, 11*b* are arranged on the inner and the outer circumferences of the arrangement circle of the selecting stationary contact points 4 to support the movable contact points 13. Therefore, in contrast to the conventional structure in which an elastic support portion, (having the shape of a bowl laid upside down), surrounds each selecting stationary contact point 4, it is possible to reduce the circumferential distance between adjacent selecting stationary contact points 4. Accordingly, the diameter of the arrangement circle of the selecting stationary contact points 4 can be reduced, and the entire lever switch can be reduced in size.

Further, it is not necessary to provide operating pins to push the movable contact points 13 used for the selecting switch. Rather, the operating section 32 is capable of tilting integrally with the operating lever 40 so that the selecting switch operating section 10 can be directly pushed by the operating section 32. Thus, it is not necessary to provide supporting members for supporting the operating pins. Also, in contrast to the conventional structure in which a cylindrical supporting member for supporting the operating pin is provided for each selecting stationary contact point, it is possible to reduce the circumferential distance between adjacent selecting stationary contact points 4. Thus, the diameter of the arrangement circle of the selecting stationary contact points 4 can be reduced, and the entire lever switch can be reduced in size.

When the pushing section 33 pushes the pushing portion 12 and the movable contact point 13 comes into contact with the selecting stationary contact point 4, the lower surface of the pushing section 33 is horizontal and pushes the upper surface of the pushing portion 12. Accordingly, the movable contact point 13 squarely faces the selecting stationary contact point 13. Therefore, the movable contact point 13 stably contacts with the selecting stationary contact point 4.

Since the operating section 32 displaced integrally with the operating lever 40 is tilted and displaced in a region lower than the tilting center, the pushing section 33 at an end of the operating section 32 is displaced from the outer circumference to the center of the arrangement circle of the selecting stationary contact points 4 when the selecting switch operating section 10 is pushed. Accordingly, in contrast to the conventional structure in which the pushing section is displaced onto the outer circumference so as to push the selecting switch operating portion, it is possible to reduce the diameter of the arrangement circle of the selecting stationary contact points.

Also, the tilting center of the operating lever 40 is located at a relatively high position, the length of an arm from the tilting center to the pushing position at which the operating section 32 pushes the selecting switch operating portion 10 can be long. Accordingly, even if the operational angle of the operating lever 40 is small, the switch can be positively operated.

According to the first embodiment, rotation of the operating lever 40 with respect to the tilting body 30 is prohibited when the supporting hole 34 of the tilting body 30 is in the form of a cross and the section of the leg portion 41 of the operating lever 40 to be inserted into the supporting hole 34 is in the form of a cross. Accordingly, it is possible to avoid an operational mistake such as a tilt of the operating lever 40 by mistake where the knob portion 42 of the operating lever 40 is held by an operator. Where it is impossible for the operating lever 40 to be rotated, an indication for indicating a tilting direction may be added to an upper surface of the knob portion 42 of the operating lever 40 enhancing operation.

Referring to FIGS. 8 to 11, a second embodiment of the invention will now be explained below. Components or portions comparable to those of the first embodiment are denoted by comparable reference numerals and will not be described again. The components and portions that distinguish the second embodiments from the first embodiment are denoted by different numerals and will be described in detail.

Figure 8:
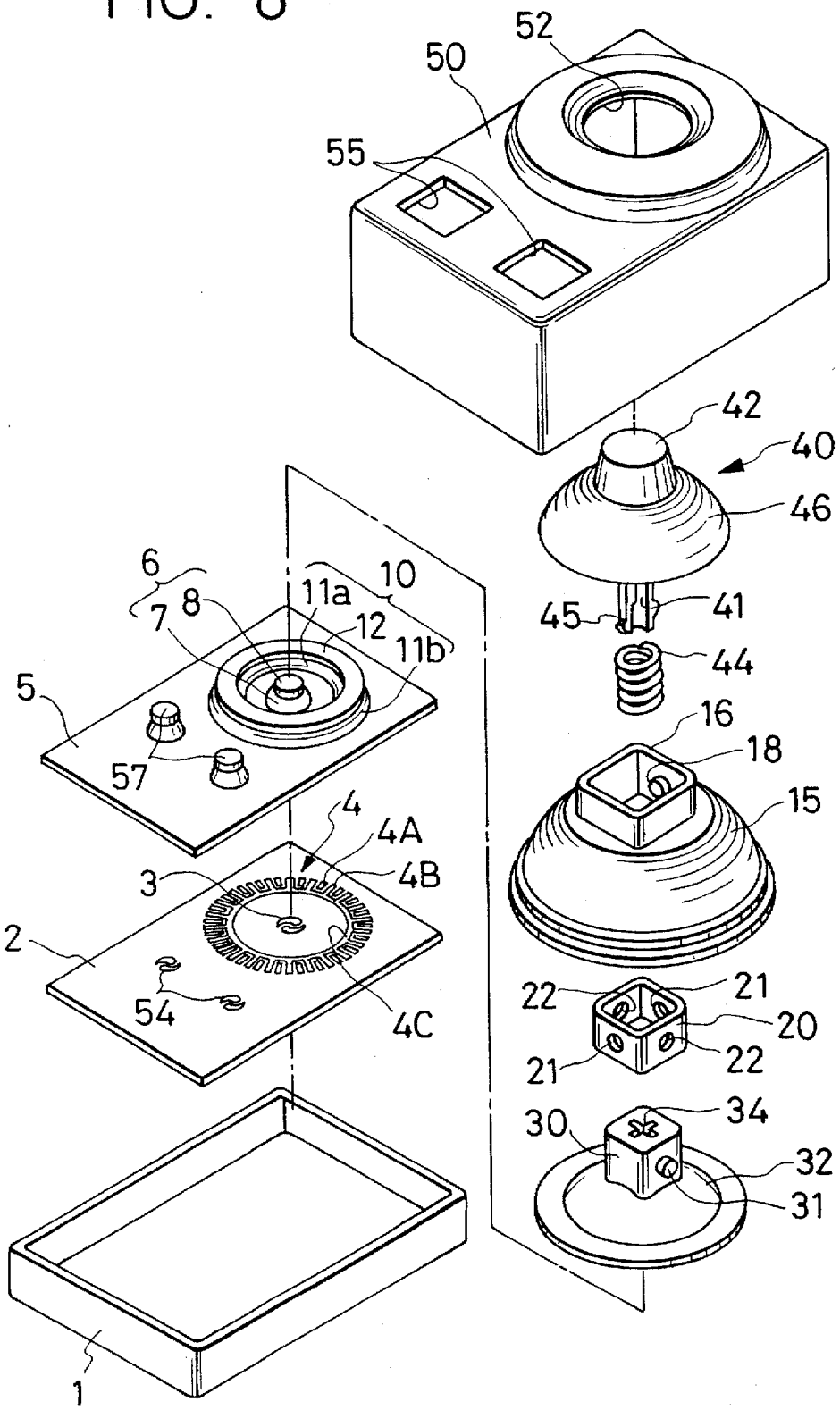
FIG. 8 is an exploded perspective view of a second embodiment of the invention.
Figure 9:
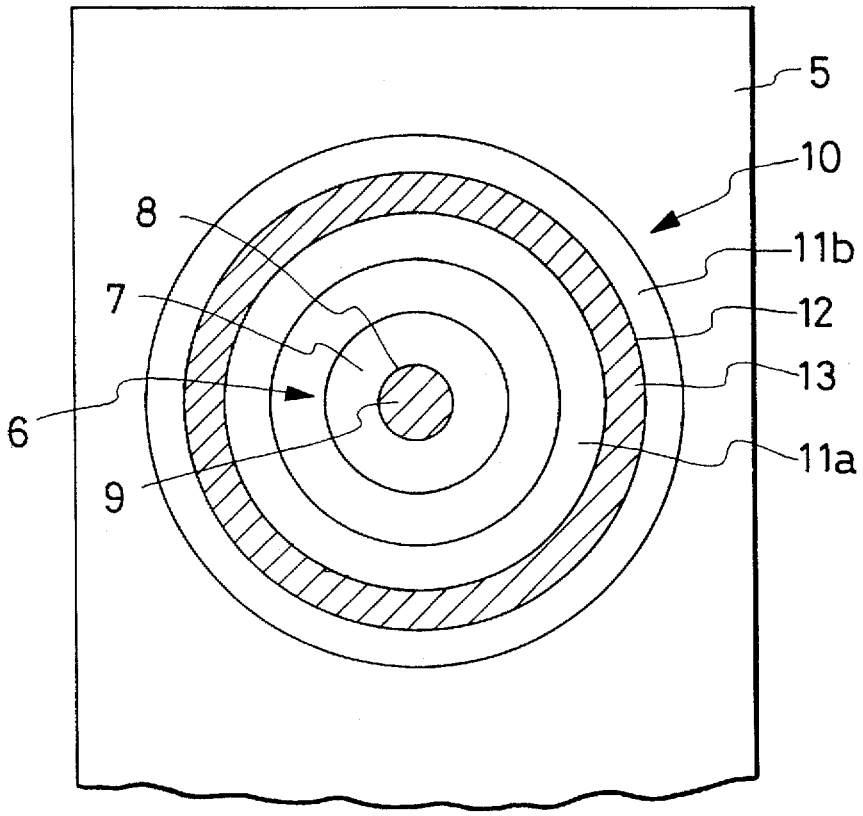
FIG. 9 is a rear view of the selecting switch operating section showing the shape of a movable contact point.

As shown in FIG. 8, the second embodiment includes a case 1, a printed board 2, a switch cover 5, a setting switch operating section 6, a selecting switch operating section 10, an operating lever 40 and cover 50 similar to the first embodiment. A setting stationary contact point 3, formed of a pair of electrodes, is located on the front surface of printed board 2, and selecting stationary contact points 4 are located at the circumference of a circle, at the center of which is located the setting stationary contact point 3 to form the arrangement circle.

Figure 10:
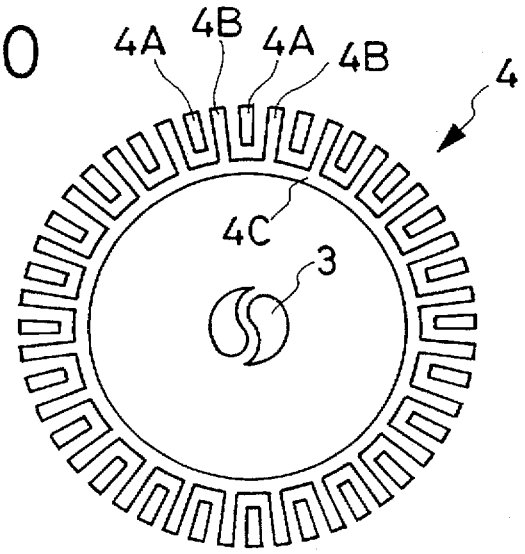
FIG. 10 is a partially enlarged plan view showing an arrangement of the selecting stationary contact points.

Each selecting stationary contact point 4 includes at least a portion least a portion of an independent electrode 4A and at least a portion of a common electrode 4B. Twenty-four stationary contact points 4, for example, are arranged in the circumferential direction at regular angular intervals. FIG. 10 is an enlarged view of the arrangement of the stationary contact points 4. As shown in FIG. 10, the stationary contact points 4 are arranged as follows. The independent electrodes 4A are arranged in a circular pattern and extend lengthwise in the radial direction between the adjacent independent electrodes 4A, 4A. Twenty-four common electrodes, e.g., 4B are interposed. The common electrodes 4B also extend lengthwise in the radial direction. All of the common electrodes 4B are connected with each other and grounded by a circular connecting section 4C arranged along an inner The circumference of the circle. Because the common electrode 4B is common to all of the selecting stationary contact points 4, when an arbitrary independent electrode 4A is short-circuited to one or both of the common electrodes 4B, 4B disposed on both of its sides, the entire circuit including the independent electrode 4A is electrically contacted.

Figure 11:
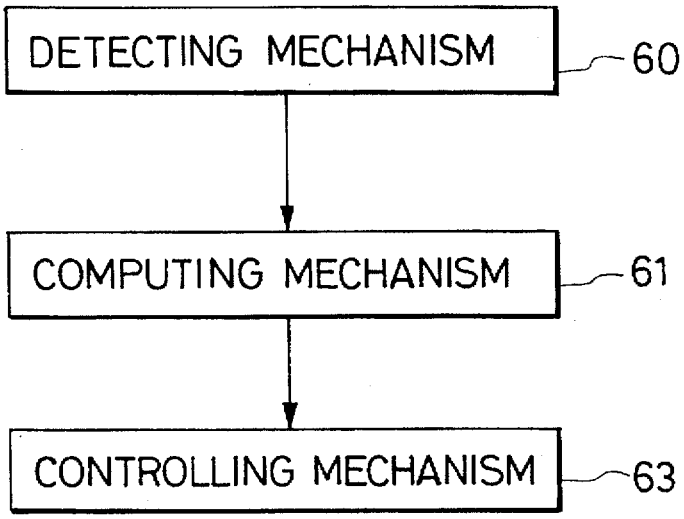
FIG. 11 is a block diagram showing a mechanism for enhancing resolution in the operating direction.

As shown in FIG. 11, the second embodiment further includes a short circuit detecting mechanism 60 that detects stationary contact points 4 that have been short-circuited, a computing mechanism 61 that computes a center of the region in which a plurality of stationary contact points 4, which have been short-circuited, are located, a controlling mechanism 63 that controls the operation of a device (not shown) in accordance with an operating direction of the operating lever 40 described later. The controlling mechanism 63 determines that a position computed by the computing mechanism 61 is an operating direction of the operating lever 40.

A specific example of determining the operating direction will be described below. If, for example, the selecting stationary contact points 4 are numbered from 1st to 24th in order, when five selecting stationary contact points 4, the numbers of which are 2nd to 6th, are short-circuited, a position of the 4th selecting stationary contact point 4 is determined to be an operating direction. When four selecting stationary contact points 4, the numbers of which are 2nd to 5th, are short-circuited, an intermediate position between the 3rd selecting stationary contact point 4 and the 4th selecting stationary contact point 4 is determined to be an operating direction. Thus, as described above, when the number of the short-circuited stationary contact points 4 is an even number, a position different from the positions at which the selecting stationary contact points 4 are located is assumed to be an operating direction. Therefore, the resolution in the operating direction is forty-eight directions which is twice as large as the number of the selecting stationary contact points 4 that have actually been employed.

Since the movable contact points 13 are elastic, the higher the operating force of the operating lever 40, the larger the amount of deflection of the movable contact points 13, and the number of the selecting stationary contact points 4 that are simultaneously short-circuited is increased. An intensity of the operating force is decided as follows. In the controlling mechanism 63, in accordance with a detecting signal sent from the short circuit detecting mechanism 60, the number of the selecting stationary contact points 4 that are simultaneously short-circuited is counted. It is assumed that the larger the counted value, the higher the operating force of the operating lever 40. It is also assumed that the smaller the counted value, the lower the operating force of the operating lever 40. An intensity of the operating force is decided in accordance with the counted value.

As in the first embodiment, when the tilting body 30 is tilted, a portion of the periphery of the operating section 32 located in the tilting direction is displaced downward and pushes the portion 12 to be pushed. Therefore, the movable contact point 13 is tilted and contacted with the selecting stationary contact point 4, so that a circuit including the selecting stationary contact point 4 is changed over into ON condition.

At this time, when the movable contact point 13 simultaneously comes into contact with a plurality of selecting stationary contact points 4 which are continuously disposed in the circumferential direction, the operating direction is decided to be one direction by the short circuit detecting mechanism 60, computing mechanism 61 and controlling mechanism 63.

In accordance with the number of selecting stationary contact points 4 that have been simultaneously short-circuited, an intensity of the operating force of the operating lever 40 is decided. In accordance with this decided intensity of the operating force, for example, highly sophisticated control can be performed such that the higher the intensity of the operating force is, the higher the image plane scrolling speed is increased.

Because in the second embodiment, a short circuit detecting mechanism 60, a computing mechanism 61 and a controlling mechanism 63 are provided, an intermediate position between the stationary contact points 4 can be determined to be the operating direction of the operating lever 40. Accordingly, in contrast to structure in which only the actual position of the selecting stationary contact point 4 is used as an operating direction, the resolution in the operating direction can be enhanced. Further, since one of the electrodes composing the selecting stationary contact points 4 is a common electrode for all of the selecting stationary contact points 4, the length of wiring in the circuit can be reduced and the wiring can be simplified.

Figure 12:
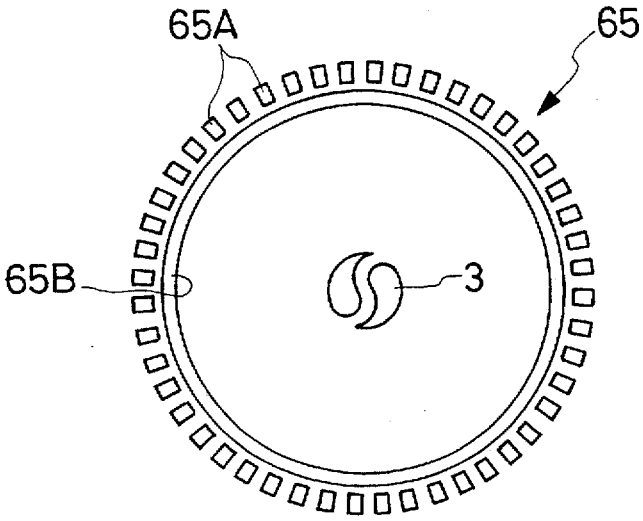
FIG. 12 is a partially enlarged plan view showing an arrangement of the selecting stationary contact points according to the third embodiment.

Referring to FIG. 12, a third embodiment of the invention will now be explained below. Components or portions comparable to those of the first and second embodiments are denoted by comparable reference numerals and will not be described again. The components and portions that distinguish the third embodiment from the first and second embodiments are denoted by different numerals and will be described in detail.

The arrangement of the selecting stationary contact points of the third embodiment is different from that of the second embodiment. In the third embodiment, each selecting stationary contact point 65 includes a piece of substantially square independent electrode 65A and a ring-shaped common contact points 65B that is common to all of the other selecting stationary contact points 65. As shown in FIG. 12, forty-eight pieces of independent electrodes 65A are arranged in the circumferential direction at the minimum regular angular spacing. A common electrode 65B is positioned on the inner circumference of the independent electrodes 65A.

As described above, two pieces of electrodes 65A and 65B in the radial direction form each selecting stationary contact point 65. Accordingly, when the third embodiment is compared to the second embodiment with regard to the diameter of the arrangement circle, the width of the electrode in the circumferential direction and the spacing of the electrodes are the same. However, the resolution of the selecting stationary contact points 65 is doubled.

When the short circuit detecting mechanism 60, the computing mechanism 61 and the controlling mechanism 63 are employed in the same manner as that of the second embodiment, the resolution in the operating direction is further doubled. Accordingly, it is possible to conduct the selecting operation in ninety-six (96) directions.

It should be noted that the invention is not limited to the specific embodiments described above with reference to the accompanying drawings. For example, the following alternative embodiments are included in the technical scope of the invention, and variations may be made by one skilled in the art without departing from the scope of the invention.

In the above embodiments, the selecting switch operating section includes an elastic support wall and a pushing portion, and the selecting switch operating section is directly pushed by the operating section tilted integrally with the operating lever. However, in the same manner as that of the setting switch operating section, the selecting switch operating section may be formed into a shape of an upside down bowl surrounding each selecting stationary contact point, and directly pushed by the operating section. Alternatively, the selecting switch operating section may include an elastic support wall and a head portion. The selecting switch operating section may be pushed by an operating pin displaced upward and downward independently from the operating lever.

Further, the setting switch mechanism is turned on and off when the operating lever is pushed. However, it is possible to apply the invention to a situation in which the setting switch mechanism is not provided, but only the selecting switch mechanism is provided, which is turned on and off when the tilting lever is operated.

The invention is structured such that the axes of the supporting shaft and the rotary shaft for tiltably supporting the operating lever cross each other at one point making a right angle. However, according to the invention, the axes of the supporting shaft and the rotary shaft may cross each other such that the two axes are shifted from each other in the longitudinal direction of the operating lever.

Further, rotation of the operating lever with respect to the tilting body is prohibited when the supporting hole of the tilting body is in the form of a cross and the cross-section of the leg portion of the operating lever to be inserted into the supporting hole is in the form of a cross. However, the supporting hole and the cross-section of the leg portion can be other shapes, for a circle.

In the above described second embodiment, the connecting section of the common electrode is arranged on the inner circumference, however, the connecting section of the common electrode may be arranged on the outer circumference.

In the third embodiment described above, the common electrode 4B integrally connected by the connecting section 4C is used as an electrode forming the selecting stationary contact point 4. However, it is possible to eliminate the connecting electrode 4C, and structure an electrode corresponding to the common electrode 4B as an independent electrode. Also, the common electrode 65B is arranged on the inner circumference of the independent electrodes 65A. However, the common electrode 65B may be arranged on the outer circumference of the independent electrodes 65A.

Further, the ring-shaped common electrode 65B is used as an electrode forming the selecting stationary contact point 65. However, an electrode corresponding to the common electrode 65B may be divided in the circumferential direction and used as electrodes independent from each other.

The embodiments described above include the switch cover 5 made of rubber, and the movable contact points 13 attached to the cover 5. However, the switch cover may be eliminated, and the movable contact points 13 may be attached to the operating lever 40. In this structure, a spring is attached between the operating section 32 and the printed board 2 to return the tilting body to the neutral position.

In the above embodiments, the number of the selecting stationary contact points 4 is 8 or 24 or 48. However, these numbers can vary.

While the invention had been described in conjunction with preferred embodiments thereof, it is evident that many additional alternatives, modifications and variations may be apparent to those skilled in the art. Accordingly, it is intended to embrace all alternatives, modifications and variations which may fall within the spirit and broad scope of the appended claims.

What is claimed is:

1. A lever switch comprising:

a circuit board;

a plurality of stationary contact points generally arranged in a circle on the circuit board;

a plurality of movable contact points arranged in a circle and selectively coupleable with corresponding ones of the plurality of stationary contact points;

a tiltable operating lever arranged substantially at a center of the circle in which the plurality of stationary contact points are arranged, wherein at least one of the plurality of movable contact points comes into contact with at least one of the plurality of stationary contact points when the operating lever is tilted; and inner and outer elastically flexible support walls respectively forming an inner circumference and an outer circumference of the circle formed by the plurality of movable contact points, wherein the plurality of movable contact points are supported by the inner and outer elastically flexible support walls.

2. The lever switch of claim 1, wherein the elastically flexible support walls define substantially continuous circles.

3. The lever switch of claim 1, further comprising an operating section that pushes at least one of the plurality of movable contact points toward at least one of the plurality of stationary contact points when the operating section is tilted integrally with the operating lever to which the operating section is attached.

4. The lever switch of claim 3, wherein the operating section includes a pushing section that contacts with and pushes a pushing portion to which the plurality of movable contact points are attached, the pushing portion being attached to and supported by the elastically flexible support walls.

5. The lever switch of claim 3, wherein each of the plurality of stationary contact points includes at least a pair of electrodes, and wherein at least one of the plurality of movable contact points contacts at least one of the plurality of stationary contact points when the operating lever is tilted so that at least one of the plurality of pairs of electrodes can be short-circuited.

6. The lever switch of claim 5, wherein the plurality of pairs of electrodes are each arranged lengthwise in a radial direction.

7. The lever switch of claim 6, wherein one of each of the pairs of electrodes is a common electrode, and each of the common electrodes of the plurality of stationary contact points are connected with each other along the circle in which the plurality of stationary contact points are arranged.

8. The lever switch of claim 5, wherein one of each of the pairs of electrodes is a common electrode, and each of the common electrodes of the plurality of stationary contact points are connected with each other along the circle in which the plurality of stationary contact points are arranged.

9. The lever switch of claim 5, further comprising a short circuit detecting mechanism that detects which of the plurality of stationary contact points are simultaneously short-circuited, and a computing mechanism that computes a center position of a region in a circumferential direction in which the simultaneously short-circuited stationary contact points are disposed, wherein the position computed by the computing mechanism is determined to be an operating direction of the operating lever.

10. The lever switch as claimed by claim 9, further comprising a counting mechanism that counts a number of the plurality of stationary contact points that are simultaneously short-circuited, and that determines an intensity of the operating force of the operating lever in accordance with the counted number.

11. A lever switch comprising:

a circuit board;

a plurality of stationary contact points generally arranged in a circle on the circuit board;

a plurality of movable contact points attached to a pushing portion and selectively coupleable with corresponding ones of the plurality of stationary contact points;

a tiltable operating lever arranged substantially at a center of the circle in which the plurality of stationary contact points are arranged, wherein at least one of the plurality of movable contact points come into contact with at least one of the plurality of stationary contact points when the operating lever is tilted; and an operating section attached to the operating lever and including a pushing section, wherein the pushing section is structured to contact and push the pushing portion to which the plurality of movable contact points are attached so that at least one of the plurality of movable contact points is pushed toward at least one of the plurality of stationary contact points when the operating section is tilted integrally with the operating lever.

12. The lever switch of claim 11, further comprising elastically flexible support walls respectively arranged on an inner circumference and an outer circumference of the circle formed by the plurality of the movable contact points, wherein the plurality of movable contact points are supported by the elastically flexible support walls.

13. The lever switch of claim 11, wherein the elastic support walls define substantially continuous circles.

14. A lever switch comprising:

circuit board means for supporting a plurality of stationary contact points generally arranged in a circle on the circuit board means;

a plurality of movable contact points arranged in a circle and selectively coupleable with corresponding ones of the plurality of stationary contact points;

a tiltable operating lever arranged substantially at a center of the circle in which the plurality of stationary contact points are arranged, wherein at least one of the plurality of movable contact points comes into contact with at least one of the plurality of stationary contact points when the operating lever is tilted; and elastically flexible support wall means for supporting the plurality of movable contact points, the elastically flexible support wall means including inner and outer elastically flexible support walls respectively forming an inner circumference and an outer circumference of the circle formed by the plurality of movable contact points.

15. The lever switch of claim 14, wherein the operating section means includes pushing section means for contacting with and pushing a pushing portion to which the plurality of movable contact points are attached, the pushing portion being attached to and supported by the elastically flexible support wall means.

16. The lever switch of claim 14, wherein the elastically flexible support wall means define substantially continuous circles.

17. The lever switch of claim 14, further comprising operating section means for pushing the plurality of movable contact points toward the plurality of stationary contact points when the operating section means is tilted integrally with the operating lever to which the operating section means is attached.

18. The lever switch of claim 17, wherein each of the plurality of stationary contact points is formed of a plurality of electrodes, and wherein at least one of the plurality of movable contact points comes into contact with at least one of the plurality of stationary contact points when the operating lever is tilted so that the electrodes can be short-circuited.

19. The lever switch of claim 18, further comprising:

short circuit detecting means for detecting which of the plurality of stationary contact points are simultaneously short-circuited; and computing means for computing a center position of a region in a circumferential direction in which the simultaneously short-circuited stationary contact points are disposed, wherein the position computed by the computing means is determined to be an operating direction of the operating lever.

20. The lever switch of claim 19, further comprising a counting means for counting a number of the plurality of stationary contact points that are simultaneously short-circuited, and for determining an intensity of the operating force of the operating lever in accordance with the counted number.

21. A method for determining an operating direction of a lever switch, the lever switch having a plurality of stationary contact points and a plurality of movable contact points selectively coupleable with corresponding ones of the plurality of stationary contact points, using a tiltable operating lever, the method comprising:

tilting the operating lever so that at least one of the plurality of stationary contact points contacts a corresponding movable contact point;

detecting which of the plurality of stationary contact points are simultaneously short-circuited; and computing a center position of a region in a circumferential direction in which the simultaneously short-circuited stationary contact points are disposed, wherein the position computed by the computing mechanism is determined to be an operating direction of the operating lever.

22. The method of claim 21, further comprising counting a number of the plurality of stationary contact points that are simultaneously short-circuited, and determining an intensity of the operating force of the operating lever in accordance with the counted number.

23. The method of claim 21, wherein, in the computing, when the number of said short-circuited stationary contact points in the region is odd, the center position is determined to be a center contact point of said short-circuited stationary contact points in the region, and when the number thereof is even, the center position is determined to be an intermediate position between two center contact points of said short-circuited stationary contact points in the region, such that operating directions twice the number of the stationary contact points can be resolved.

* * * * *